US005611532A

United States Patent [19]

Forrest, Sr.

[11] Patent Number: 5,611,532

[45] Date of Patent: Mar. 18, 1997

[54] TETHERED FOOTBALL WITH RESILIENT END CAPS

[75] Inventor: Charles P. Forrest, Sr., Mobile, Ala.

[73] Assignees: Charles P. Forrest, Jr.; Reginald E. Forrest, Jr., both of Mobile, Ala.; part interest to each

[21] Appl. No.: 630,491

[22] Filed: Apr. 10, 1996

[51] Int. Cl.[6] ..... A63B 69/00

[52] U.S. Cl. ..... 473/576; 473/597

[58] Field of Search ..... 273/65 R, 65 A, 273/65 B, 65 E, 65 EA, 65 EC, 65 ED, 65 EE, 65 EF, 65 EG, 65 F, 58 C, 58 K, 58 B, 58 J, 413, 414

[56] References Cited

U.S. PATENT DOCUMENTS

| | | | |
|---|---|---|---|
| 2,182,053 | 12/1939 | Reach | 273/65 EG |
| 3,042,404 | 7/1962 | Masters | 273/65 A |
| 3,225,488 | 12/1965 | Goldfarb | 273/65 EE |
| 3,940,133 | 2/1976 | Civita | 273/58 C |
| 4,350,338 | 9/1982 | May | 273/58 C |
| 5,031,910 | 7/1991 | Kopp | 273/58 C |
| 5,224,704 | 7/1993 | Snell | 273/65 EC |

FOREIGN PATENT DOCUMENTS

| | | | |
|---|---|---|---|
| 2263408 | 7/1993 | United Kingdom | 273/58 C |

OTHER PUBLICATIONS

"Fran Tarkenton's Pass Play", Playthings, p. 59 Jan. 1978.

*Primary Examiner*—Steven Wong
*Attorney, Agent, or Firm*—H. Jay Spiegel

[57] ABSTRACT

A wiffle football is provided with a tether having a free end attachable to the user. The football is made of a generally rigid material, such as plastic, except that the tips are made of a resilient material designed to provide a cushioning effect and to absorb shock. The resilient tips prevent damage to the user and protect anyone in close proximity to the user.

9 Claims, 3 Drawing Sheets

TETHERED FOOTBALL WITH RESILIENT END CAPS

BACKGROUND OF THE INVENTION

The present invention relates to a tethered football with resilient end caps. In the prior art, tethered projectiles including footballs are known. However, Applicant is unaware of any such device including all of the features and aspects of the present invention. The following prior art is known to Applicant:

U.S. Pat. No. 1,655,599 to Dolan, Jr.

U.S. Pat. No. 3,940,133 to Civita

U.S. Pat. No. 3,974,536 to Franklin

U.S. Pat. No. 4,042,241 to Collins

U.S. Pat. No. 4,350,338 to May.

Dolan, Jr. teaches a football having wings attached thereto and a tether attached to the wings. The present invention differs from the teachings of Dolan, Jr. as contemplating a football having resilient ends and with a tether attached through one of the resilient ends.

Civita teaches a ball retrieving apparatus consisting of a foamed football having a tether attached at one end by a ring and a clip and attachable to the user at the other end through a wrist strap. The present invention differs from the teachings of Civita as contemplating a football having a solid body with foam ends and with the tether extending through one of the foamed ends to be attached within the football without any metal clips or rings that could injure the user.

Franklin teaches a lifesaving device consisting of a floatable member generally shaped like a football and having a cord of resilient material about which a length of synthetic thermoplastic material rope has been wound. A tether extends through the water floatable member and is attached with large knots at each end. The present invention differs from the teachings of Franklin as contemplating a lightweight football having a hollow body with resilient ends and including a tether extending through one of the resilient ends.

Collins teaches an elastic cord-attached returning soccer ball. Collins fails to appreciate the dangers involved in throwing a projectile that has sharp tips. The present invention solves this problem by rendering the tips resilient.

May teaches a football practice aid consisting of an elongated tether attached at one end to a football and at another end to a pole. The present invention differs from the teachings of May as contemplating a football having a hollow interior and resilient end caps, one of which has a tether extending therethrough.

SUMMARY OF THE INVENTION

The present invention relates to a tethered football with resilient end caps. The present invention includes the following interrelated objects, aspects and features:

(1) In a first aspect, the present invention consists of a generally hard rigid hollow body having a thin wall with a plurality of holes therethrough. Such a ball is known in the prior art as a "WIFFLE BALL".

(2) A typical football made of leather or other material has laces that are used to close an opening in the ball and are also used to be gripped by the user. In the present invention, the thin wall has simulated laces thereon which, in the preferred embodiment, consist of a resilient insert having simulated laces thereon designed to be gripped by the user.

(3) A typical "WIFFLE" football has tips integral with the body thereof which are generally pointed and are extremely hard. In the present invention, the hard body of the inventive football has flat end terminations to which are attached resilient end caps conforming to the size and shape of typical football tips. In the preferred embodiment, the end caps are made of a material such as foamed plastic.

(4) A tether is attached to the inventive football to allow the football to be attached to the clothing of the user. The tether comprises a resilient cord having a fastener at an end distal from the football. The cord is attached to the football through extension through an opening formed within one of the end caps with the said opening being aligned with a further opening formed in the adjacent flat end of the hard body of the football with a knot or other attachment means being employed to retain the tether within.

As such, it is a first object of the present invention to provide a tethered football with resilient end caps.

It is a further object of the present invention to provide such a device wherein the tether is attached by extension through an opening formed in one of the end caps thereof.

It is a yet further object of the present invention to provide such a football with simulated laces attached thereto.

It is a yet further object of the present invention to provide such a device wherein the tether is attached to the football without the use of any exposed rings, clips or knots.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 7:
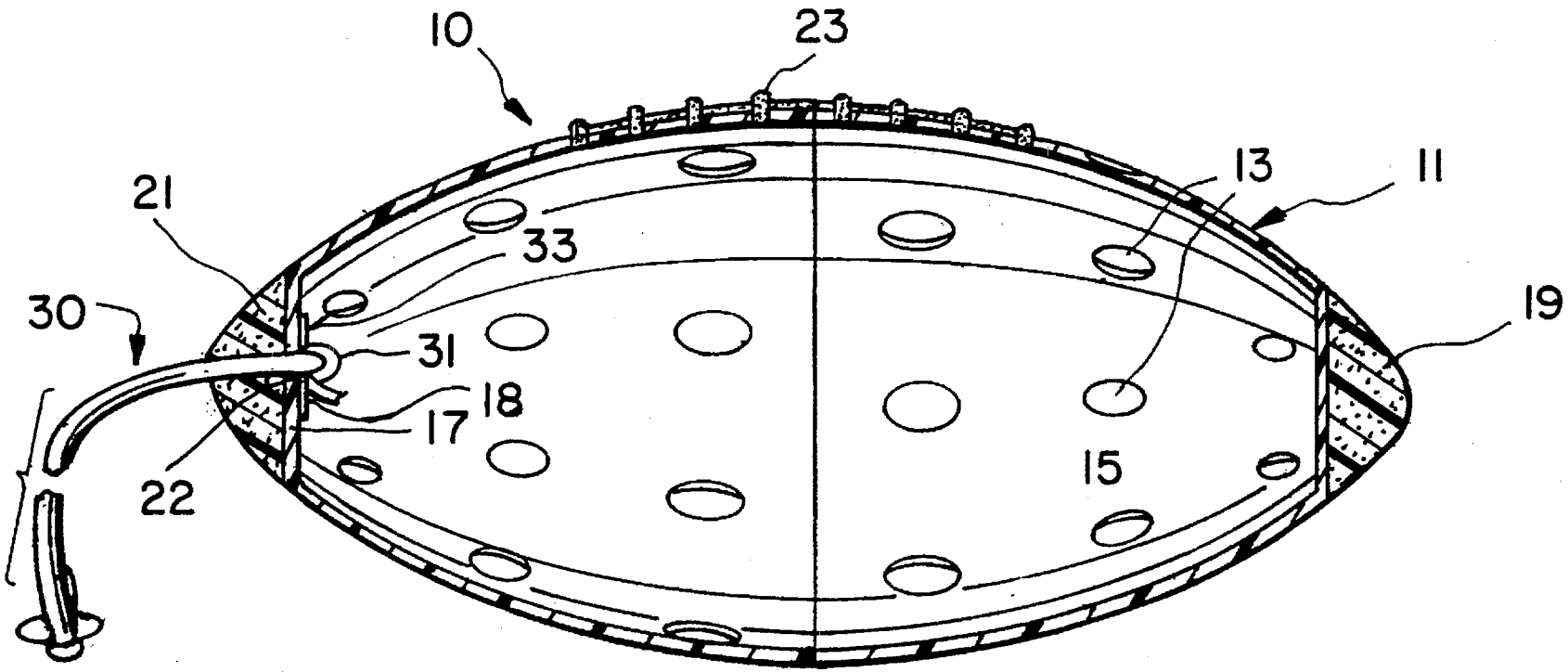
FIG. 7 shows a longitudinal cross-sectional view of the present invention.

With reference to the figures, the present invention is generally designated by the reference numeral 10 and is seen to include a hard body 11 having a multiplicity of holes therethrough 13. As best seen in FIG. 7, the body 11 is extremely thin and takes the form of a "WIFFLE BALL".

As best understood from FIG. 7, the hard body 11 terminates at flat ends 15 and 17 and end caps 19 and 21 are affixed over the respective flat ends 15 and 17 by any suitable means such as, for example, adhesive. The end caps 19 and 21 are made of a resilient material such as, for example, foamed plastic or foam rubber.

The inventive football 10 includes a set of simulated laces 23 that, as best seen in FIG. 7, are mounted over the body 11 and partially embedded therein to best facilitate firm attachment thereof. The user grips the simulated laces 23 to facilitate throwing the football 10.

As seen in the figures, a tether 30 is suitably affixed at the end of the football 10 where the end cap 21 is located. As can be seen in FIGS. 1, 3, 6 and 7, the end cap 21 is provided with an opening 22 that extends completely therethrough (FIG. 7). A further opening 18 is provided in the flat end 17, which opening is aligned with the opening 22.

Figure 1:
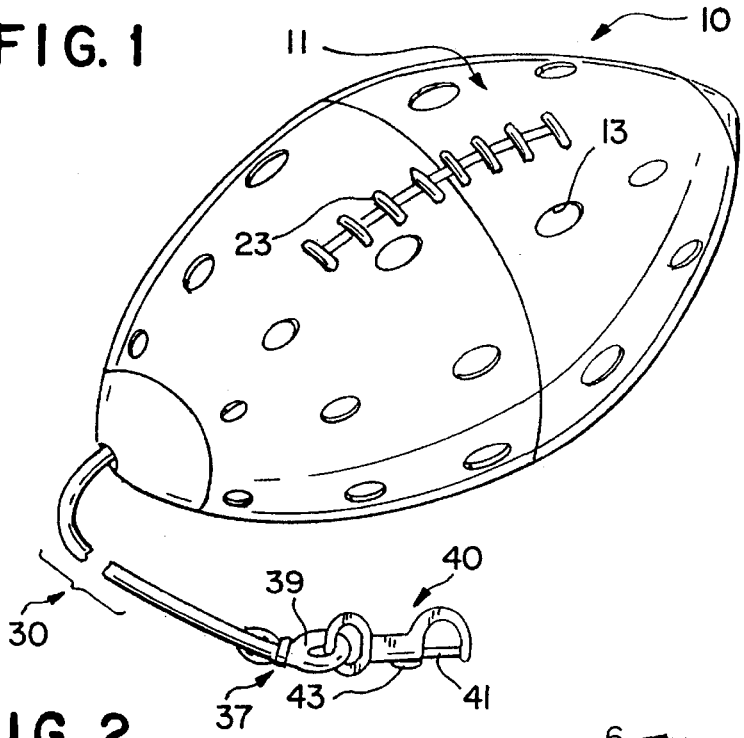
FIG. 1 shows a perspective view of the present invention.
Figure 2:
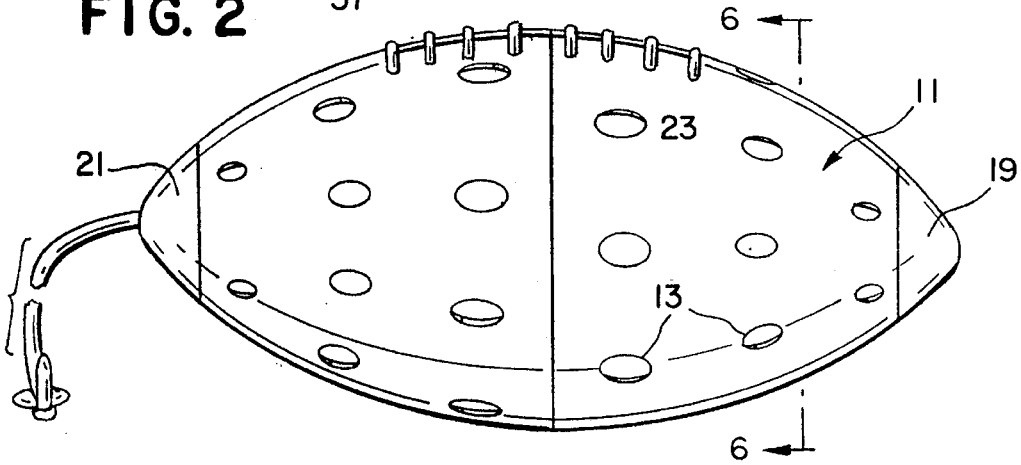
FIG. 2 shows a side view of the present invention.
Figure 3:
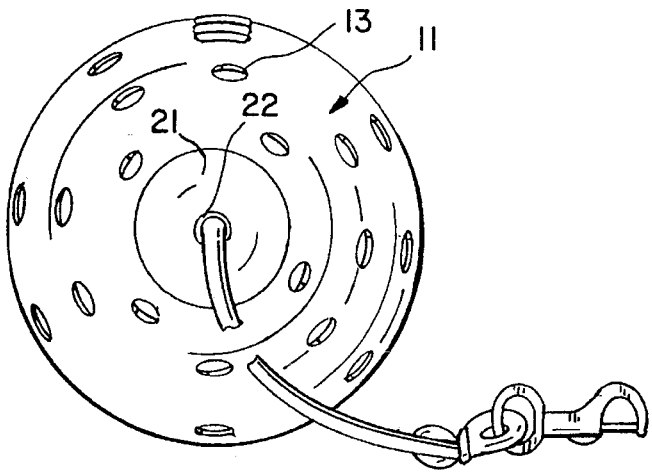
FIG. 3 shows an end view of the present invention.
Figure 4:
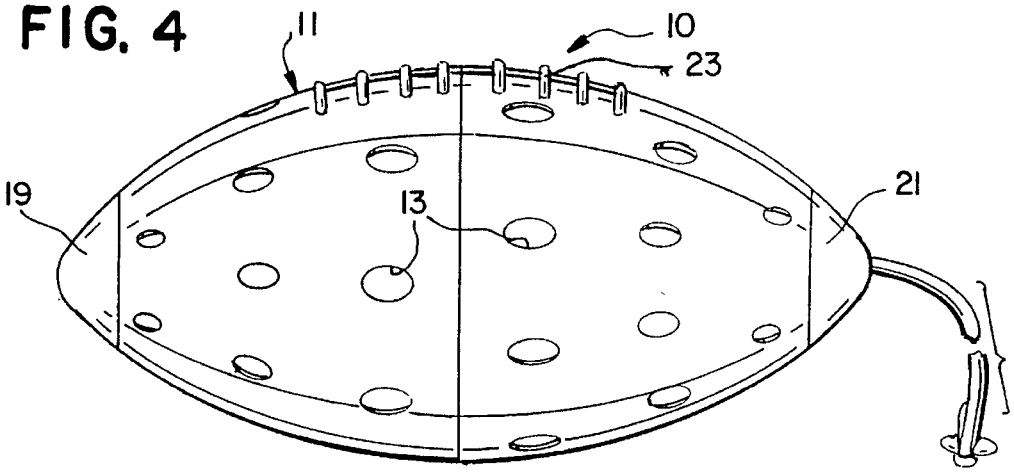
FIG. 4 shows a view from the other side as compared to FIG. 2.
Figure 5:
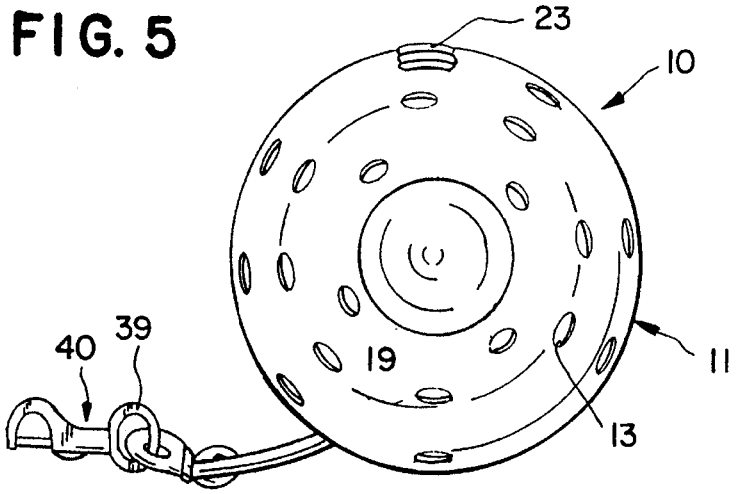
FIG. 5 shows a view from the other end as compared to FIG. 3.
Figure 6:
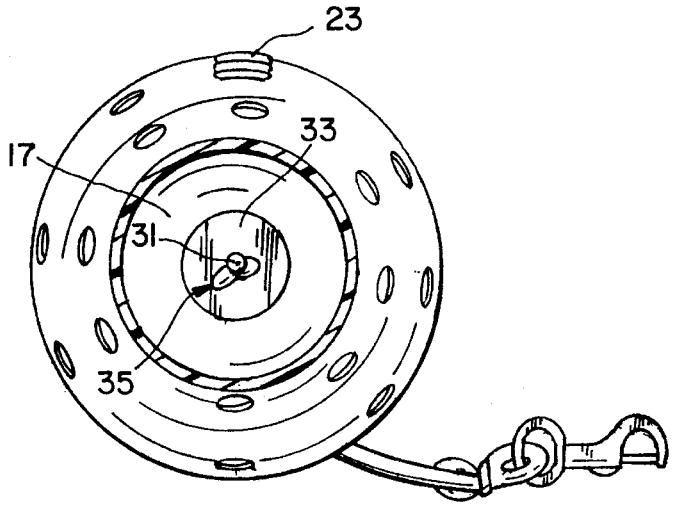
FIG. 6 shows a cross-sectional view along the line 6—6 of FIG. 2.

The tether 30 has an end 31 that is extended through the openings 22 and 18 and also extends through a washer 33 having an opening therethrough as well (FIGS. 6 and 7). As best seen in FIGS. 6 and 7, the end 31 of the tether 30 is suitably tied in a knot 35 to prevent the washer 33 from being removed and to retain the end 31 of the tether 30 within the body 11 of the football 10. At the end 37 of the tether 30 distal from the football body 11, a ring 39 is provided to which is attached a clip 40 having a reciprocable pin 41 operated through sliding motion of a sliding actuator 43 as is well known to those skilled in the art.

In the operation of the present invention, the clip 40 is attached to a suitable attachment point on the user's clothing such as, for example, a belt loop, a belt buckle, etc. The tether 30 is preferably made of an elastic material and may comprise a "BUNGEE CORD". The body 11 of the football 10 is gripped with the fingers extending over the simulated laces 33 and the football is thrown away from the user. When the tether 30 is completely extended and reaches its elastic limit, the restoring force of the tether 30 pulls the football back toward the user so that the user can suitably catch it to practice properly catching a football. The resilient end caps 19 and 21 prevent injury to the user and also prevent injury to any persons adjacent the user. Furthermore, care is taken to ensure that the tether 30, adjacent the end cap 21 outside the football, is devoid of any rings, clips, knots or any projections that could injure the user or persons adjacent thereto.

In this way, a device has been created that is safe to use and prevents injury to the user and adjacent persons.

In the preferred embodiment of the present invention, the body 11 of the inventive football is made of a material such as a hard plastic in an injection molding process. The end caps 19 and 21 are preferably made of a resilient material such as rubber, foamed rubber, foamed plastic or foamed polyurethane. The tether 30 is preferably made of a resilient elastic material such as, for example, that which is employed in "BUNGEE CORDS".

As such, an invention has been disclosed in terms of a preferred embodiment thereof which fulfills each and every one of the objects of the invention as set forth hereinabove and provides a new and useful tethered football with resilient end caps of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A tethered football comprising:

a) a hollow football body having flat ends and a plurality of holes through said body;

b) a resilient end cap shaped like a tip of an oblate spheroidal football mounted over each flat end of said body;

c) one of said end caps having an opening therethrough aligned with an opening in a flat end of said body to which said one of said end caps is attached;

d) an elastic tether having a first end and a second end, said first end extending through said openings and being secured within said body, said second end comprising means for fastening said tether to a desired object.

2. The football of claim 1, wherein said body has simulated laces thereon.

3. The football of claim 2, wherein said simulated laces are made of a resilient material.

4. The football of claim 1, wherein each end cap is made of foamed plastic.

5. The football of claim 3, wherein said simulated laces are made of foamed plastic.

6. The football of claim 1, wherein said fastening means comprises a clip.

7. The football of claim 1, wherein said first end of said tether is tied in a knot within said body.

8. The football of claim 7, further including a washer on said tether interposed between said knot and said flat end opening.

9. The football of claim 1, wherein said hollow football body is made of hard plastic.

* * * * *